US006639994B1

(12) United States Patent
Proni et al.

(10) Patent No.: US 6,639,994 B1
(45) Date of Patent: Oct. 28, 2003

(54) LOUDSPEAKER HAVING ADJUSTABLE MOTOR STRENGTH

(75) Inventors: Lucio Proni, Miramar, FL (US); Brett E. Hanes, Gainesville, GA (US)

(73) Assignee: JL Audio, Inc., Miramar, FL (US)

( * ) Notice: Subject to any disclaimer, the term of this patent is extended or adjusted under 35 U.S.C. 154(b) by 234 days.

(21) Appl. No.: 09/640,385

(22) Filed: Aug. 16, 2000

(51) Int. Cl.[7] ..... H04R 9/06
(52) U.S. Cl. ..... 381/406; 381/414
(58) Field of Search ..... 381/96, 396, 400, 381/401, 406, 413, 414, 418, 421, 111, 117

(56) References Cited

U.S. PATENT DOCUMENTS

| | | | | |
|---|---|---|---|---|
| 1,707,617 A | | 4/1929 | Kellogg | |
| 1,814,119 A | | 7/1931 | Bradbury | |
| 1,830,401 A | | 11/1931 | Miessner | |
| 1,830,402 A | | 11/1931 | Miessner | |
| 1,909,275 A | | 5/1933 | Holland | |
| 1,937,602 A | | 12/1933 | Stewart | 179/171 |
| 4,243,839 A | * | 1/1981 | Takahashi et al. | 381/96 |
| 4,609,784 A | | 9/1986 | Miller | 179/115.5 DV |
| 4,807,295 A | | 2/1989 | Dombroski | 381/194 |
| 5,828,767 A | | 10/1998 | Button | 381/195 |
| 5,909,496 A | * | 6/1999 | Kishigami et al. | 381/111 |

* cited by examiner

*Primary Examiner*—Curtis Kuntz
*Assistant Examiner*—B Ensey
(74) *Attorney, Agent, or Firm*—Holland & Knight LLP

(57) ABSTRACT

A loudspeaker comprises a motor structure which incorporates a magnetic flux control system including a field winding, a controller connected between a voltage source and the field winding and, a polarity reversal switch preferably located across the filed winding. The magnetic flux control system is operative to produce a magnetic flux, which, depending on the level and polarity of electrical current supplied to the field winding, either reinforces or opposes the static magnetic flux produced by the magnet of the motor structure of the loudspeaker, thus altering the motor strength of the loudspeaker system.

31 Claims, 5 Drawing Sheets

LOUDSPEAKER HAVING ADJUSTABLE MOTOR STRENGTH

FIELD OF THE INVENTION

This invention relates to loudspeakers, and, more particularly, to a method and apparatus for varying the motor strength of a loudspeaker to alter its frequency response and damping characteristics.

BACKGROUND OF THE INVENTION

Loudspeakers generally comprise a frame, a motor structure, a diaphragm connected to an upper suspension or surround and a spider or lower suspension. In one common type of speaker, the motor structure includes a permanent magnet mounted between a top plate and a back plate. A pole piece is centrally mounted on the back place and concentrically disposed within a bore formed in the permanent magnet and an aligning bore formed in the top plate. A space is provided between the top plate and pole piece defining a magnetic gap within which lines of magnetic flux are produced by the permanent magnet. One alternative speaker design, commonly known as a "pot" type speaker, employs a somewhat different motor structure in which the pole piece is centrally disposed on and connected to the back plate, while a permanent magnet is connected between the pole piece and top plate. A pot wall concentrically surrounds the pole piece, magnet and top plate, and forms a magnetic gap with the top plate within which lines of magnetic flux are produced by the permanent magnet. In both types of speakers, a voice coil is provided including a hollow, cylindrical-shaped former having an outer surface which mounts a winding of wire.

In each speaker design noted above, one end of the diaphragm is connected to the surround, which, in turn, is mounted to the upper end of the frame. The spider is connected at one end to a seat formed in the frame at a point between its upper and lower ends. The free ends of the diaphragm and spider are mounted to the voice coil and support it within the magnetic gap in the motor structure such that the former of the voice coil is concentrically disposed about the pole piece and the voice coil winding is axially moveable within the magnetic gap.

The permanent magnet associated with the motor structure or driver in each of the speakers described above produces a "static" or essentially constant DC magnetic flux within the magnetic gap. In the course of operating a loudspeaker, electrical current is supplied to the wire winding of the voice coil, which, in turn, is located in the magnetic gap. When energized, the voice coil produces an AC flux which alternately has a positive value and a negative value, both of which are less than the static DC flux produced by the permanent magnet.

The AC flux from the voice coil acts with the DC flux within the magnet to cause axial movement of the voice coil within the magnetic gap.

For one polarity of current supplied to the voice coil the magnetic flux from the magnet is reinforced, while energizing the voice coil with current of the opposite polarity causes the voice coil to develop a magnetic flux which opposes that of the magnet. Hence, the voice coil flux modulates the static flux produced by the magnet within the magnetic gap.

The degree of force applied by the motor structure of a loudspeaker, which is an indication of the strength of the motor, is defined by the following relationship:

| | | | |
|---|---|---|---|
| | Force | = | BLI |
| Where: | B | = | average peak magnitude of static magnetic flux in magnetic gap |
| | L | = | total length of voice coil wire acted upon by B |
| | I | = | current through the voice coil |

If the current I through the voice coil is one (1) ampere or normalized to one (1) ampere, then the product of B and L represents the force per ampere applied by the motor structure of the loudspeaker on the voice coil. The term "L" specifically refers to the total length of the wire forming the wire winding carried on the outer surface of the former of the voice coil. As a practical matter, the magnetic flux produced by the voice coil has a greater effect when the polarity is such that it reinforces the DC magnetic flux of the magnet than when its polarity is reversed. As a result, the force exerted by the motor structure on the voice coil, or BL (per ampere) is different depending on the polarity of the current to the voice coil. This modulation is a clear source of distortion in the performance of most loudspeakers.

In addition to problems with distortion created by modulation of the static magnetic flux within the magnetic gap, motor structures in conventional loudspeakers have no means for altering their frequency response or damping characteristics. As a result, the acoustic output of such speakers is fixed unless an attempt is made to alter the loudspeaker enclosure. This is often impractical, and in many instances the speaker may not be capable of providing the desired response even in a new enclosure due to fundamental speaker characteristics. In order to meet varying needs, a wider variety of speakers may be required which is too costly for many consumers.

SUMMARY OF THE INVENTION

It is therefore among the objectives of this invention to provide a motor structure for a loudspeaker which is adjustable in strength to permit variation of the motor's frequency response and damping characteristics, which is capable of operating with different types of loudspeakers including pot-type speakers, which is simple in construction and economical to implement.

These objectives are accomplished in a loudspeaker having a motor structure which incorporates a magnetic flux control system including a field winding, a voltage or resistance controller connected between a voltage source and the field winding and, a polarity reversal switch preferably connected across the field winding. The magnetic flux control circuit is operative to produce a magnetic flux, which, depending on the level and polarity of electrical current supplied to the field winding, either reinforces or opposes the static magnetic flux produced by the magnet of the motor structure of the loudspeaker.

This invention is predicated on the concept of controlling the acoustic output of a loudspeaker by providing a motor structure whose strength can be varied on the order of about plus or minus twenty percent to accommodate a comparatively broad range of operating conditions. If the current supplied to the field winding results in a magnetic flux which reinforces the magnetic flux of the permanent magnet of the motor, the motor strength increases thus increasing the damping effect of the motor. Conversely, developing a magnetic flux in the field winding which opposes the static magnetic flux of the permanent magnet decreases the motor strength and reduces the damping effect of the motor.

In one presently preferred embodiment, the motor structure conventionally includes a back plate, a pole piece centrally mounted on the back plate, and, a top plate and permanent magnet concentrically disposed about the pole piece. A magnetic gap is formed between the top plate and pole piece across which lines of magnetic flux are produced by the permanent magnet. In this embodiment, the field winding is either mounted directly to the pole piece, or the field winding is a free-standing structure mounted to the back plate in the space between the pole piece and magnet. The field winding is positioned to generate lines of flux which are effective to reinforce or oppose those produced by the permanent magnet within the magnetic gap.

In an alternative embodiment, a "pot" type motor structure employed including a back plate, a pole piece centrally mounted on the back plate, a permanent magnet mounted atop the pole piece and a top plate mounted to the magnet. A pot wall is circumferentially disposed about the pole piece, magnet and top plate forming a magnetic gap with the top plate. In this embodiment, the field coil is either mounted to the pole piece or to the pot wall and produces lines of magnetic flux which either oppose or reinforce those created by the permanent magnet within the magnetic gap.

Regardless of the type of motor structure employed in the speakers of this invention, the magnetic flux control system determines the level and polarity of the current supplied to the field winding. In one presently preferred embodiment, the magnetic flux control system comprises a polarity reversal switch and a controller in the form of an adjustable voltage regulator located between a source of voltage and the field winding. The adjustable voltage regulator effectively regulates the level of voltage supplied to the field winding, whose polarity is changed by the polarity reversal switch, thus providing a comparatively large variation in the magnetic flux produced by the field winding. In an alternative embodiment, the controller of the magnetic flux system comprises a number of lines each containing a different resistor, or no resistor at all, connected to a multi-position switch. The lines are arranged in parallel to one another but are serially connected between a voltage source and the polarity reversal switch, which, in turn, connects to the field winding. The multi-position switch is effective to form a completed circuit between the voltage source and field winding, via any one of the lines, thus introducing a different line resistance, which, in turn, alters the current level supplied to the field winding.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE PREFERRED EMBODIMENT

Figure 1:
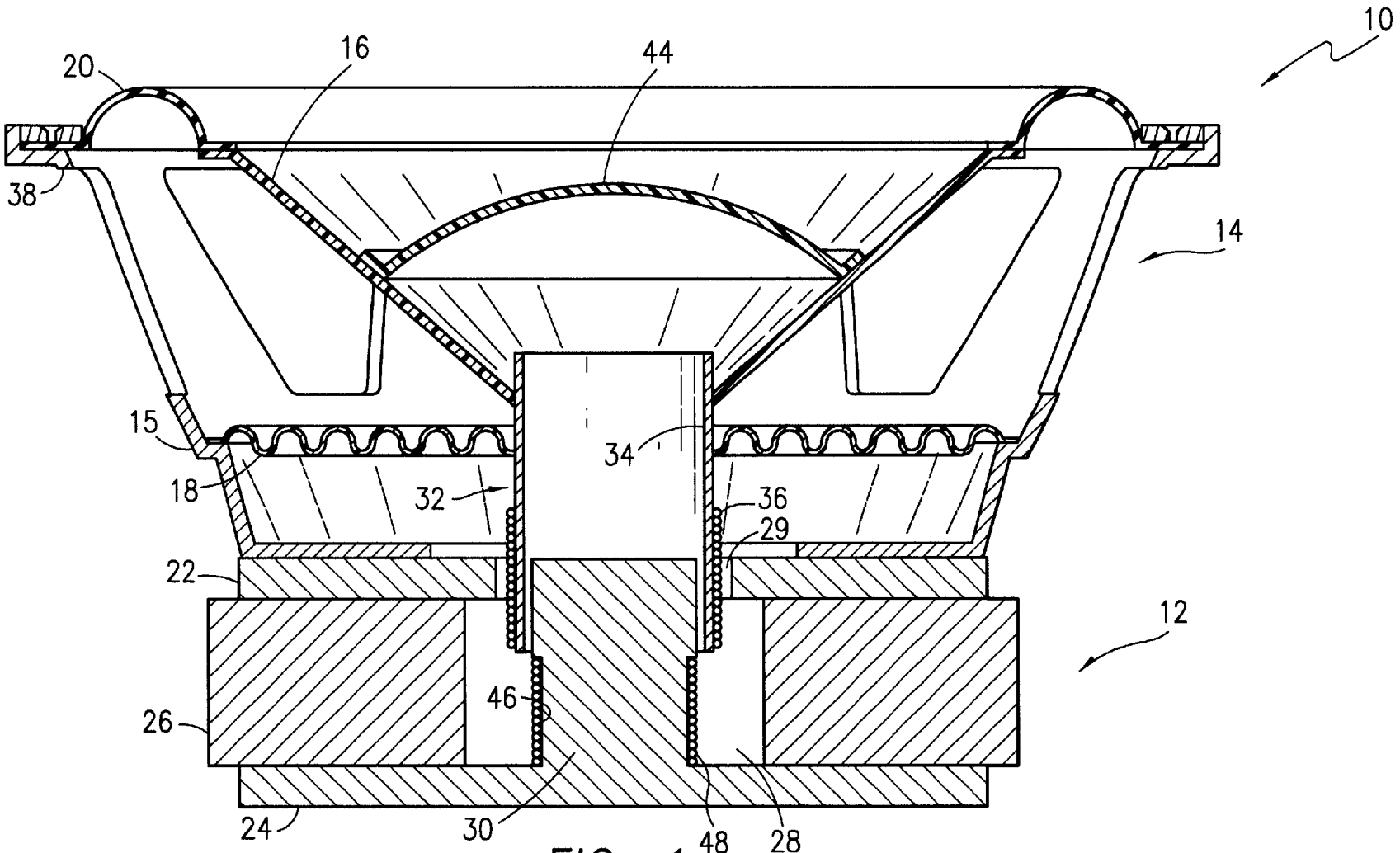
FIG. 1 is an elevational view, in partial cross-section, of one type of loudspeaker incorporating one embodiment of the field winding portion of the magnetic flux control circuit of this invention.
Figure 2:
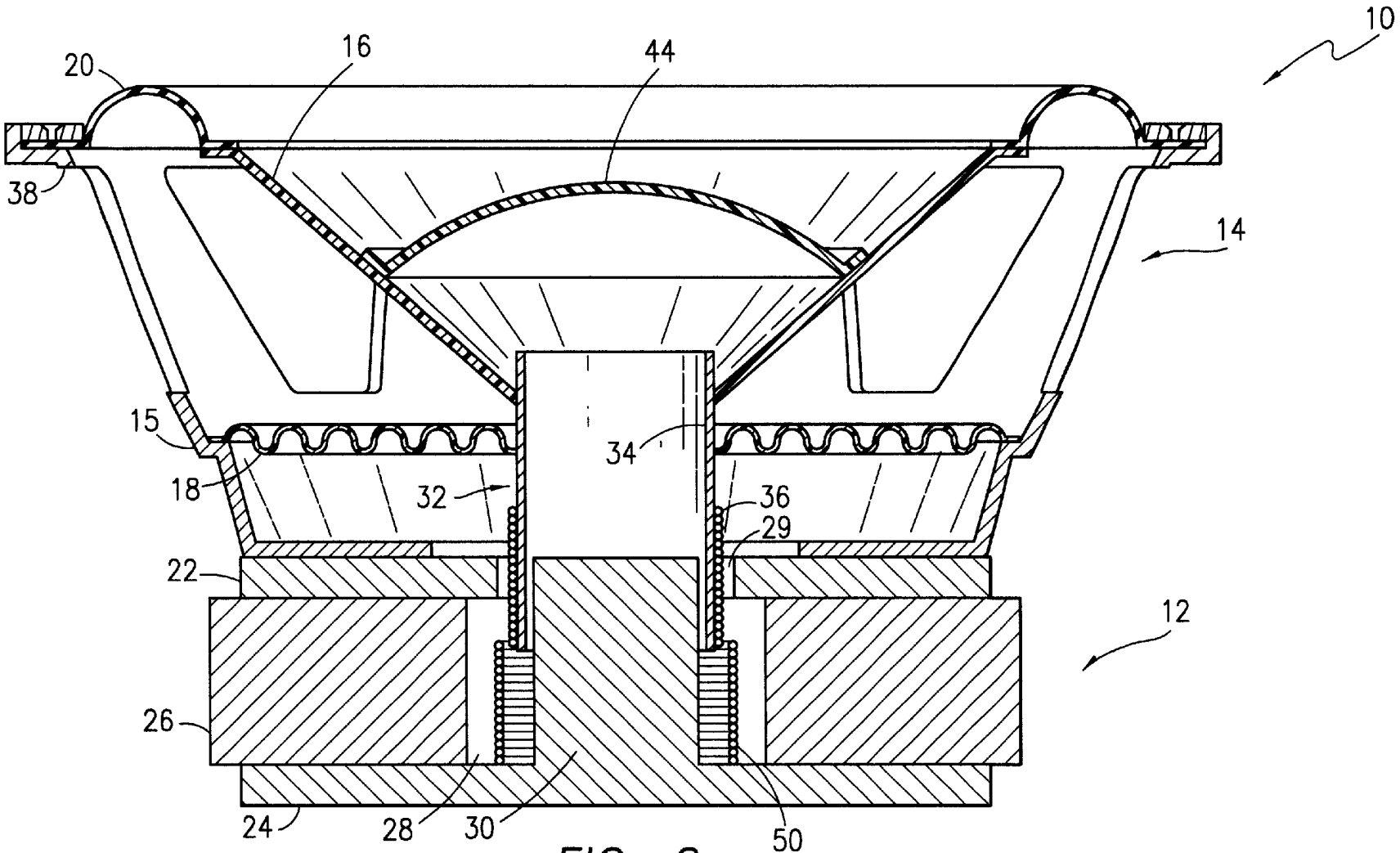
FIG. 2 is a view similar to FIG. 1 but with an alternative embodiment of the field winding.

Referring initially to FIGS. 1 and 2, a loudspeaker 10 is illustrated which generally comprises a motor structure 12, a frame 14 mounted to the motor structure 12, a diaphragm 16, a lower suspension or spider 18 and an upper suspension or surround 20. In this embodiment, the motor structure 12 includes a top plate 22 and a back plate 24 which are spaced from one another and mount a permanent magnet 26 therebetween. A pole piece 30 is integrally formed with and extends upwardly from the back plate 24 into a central bore 28 formed in both the magnet 26 and top plate 22. A magnetic gap 29 is formed between the top plate 22 and the pole piece 30 within which lines of magnetic flux (not shown) are created by the permanent magnet 26. A voice coil 32 is also provided which includes a hollow, cylindrical-shaped former 34 having an outer surface which mounts a wire winding 36. The former 34 is concentrically disposed about the pole piece 30, and the voice coil 32 is axially movable within the magnetic gap 29 during operation of the speaker 10.

The voice coil 32 is held in place within the magnetic gap 29 by the diaphragm 16, spider 18 and surround 20. One end of the diaphragm 16 is affixed to the former 34 by adhesive or the like, and its opposite connects to the surround 20. The surround 20, in turn, is mounted to the upper end 38 of the frame 14 as shown. The diaphragm 16 and surround 20 collectively provide support for the voice coil 32 in addition to the lower suspension or spider 18. As shown in the Figures, one end of the spider 18 connects to the former 34, and its opposite end mounts to a seat 15 formed in frame 14. A dust cap 44 is mounted to the diaphragm 16 in position to overlie the voice coil 32 and pole piece 30 in order to protect such elements from dirt, dust and other contaminants.

In one presently preferred embodiment, a recess 46 is formed in the pole piece 30 from the back plate 24 upwardly part way along the pole piece 30. The recess 46 receives the turns or coils of a field winding 48. As discussed below, the field winding 48 is effective to create lines of magnetic flux which either reinforce or oppose the lines of magnetic flux within the magnetic gap 29 produced by permanent magnet 26. In an alternative embodiment disclosed in FIG. 2, a field winding 50 is affixed to the back plate 24, such as by glue or the like, in a position within the central bore 28 between the pole piece 30 and magnet 26. The field winding 50 performs the same function as the field winding 48, as described below, except it eliminates the need for machining of the pole piece 30 to form the recess 46 as depicted in FIG. 1.

Figure 3:
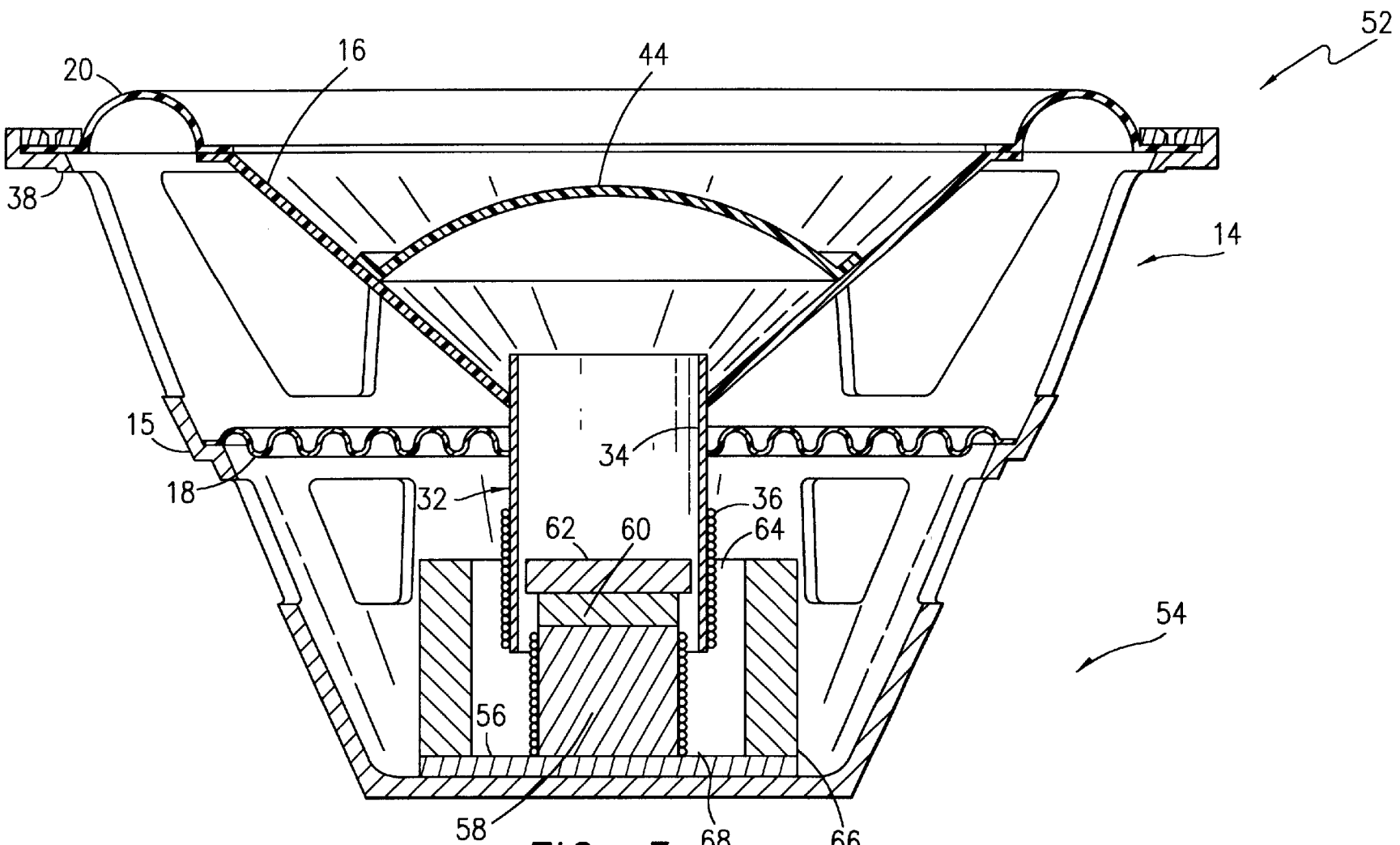
FIG. 3 is an elevational view in partial cross-section of a pot-type speaker employing one embodiment of the field winding portion of the magnetic flux control circuit herein.
Figure 4:
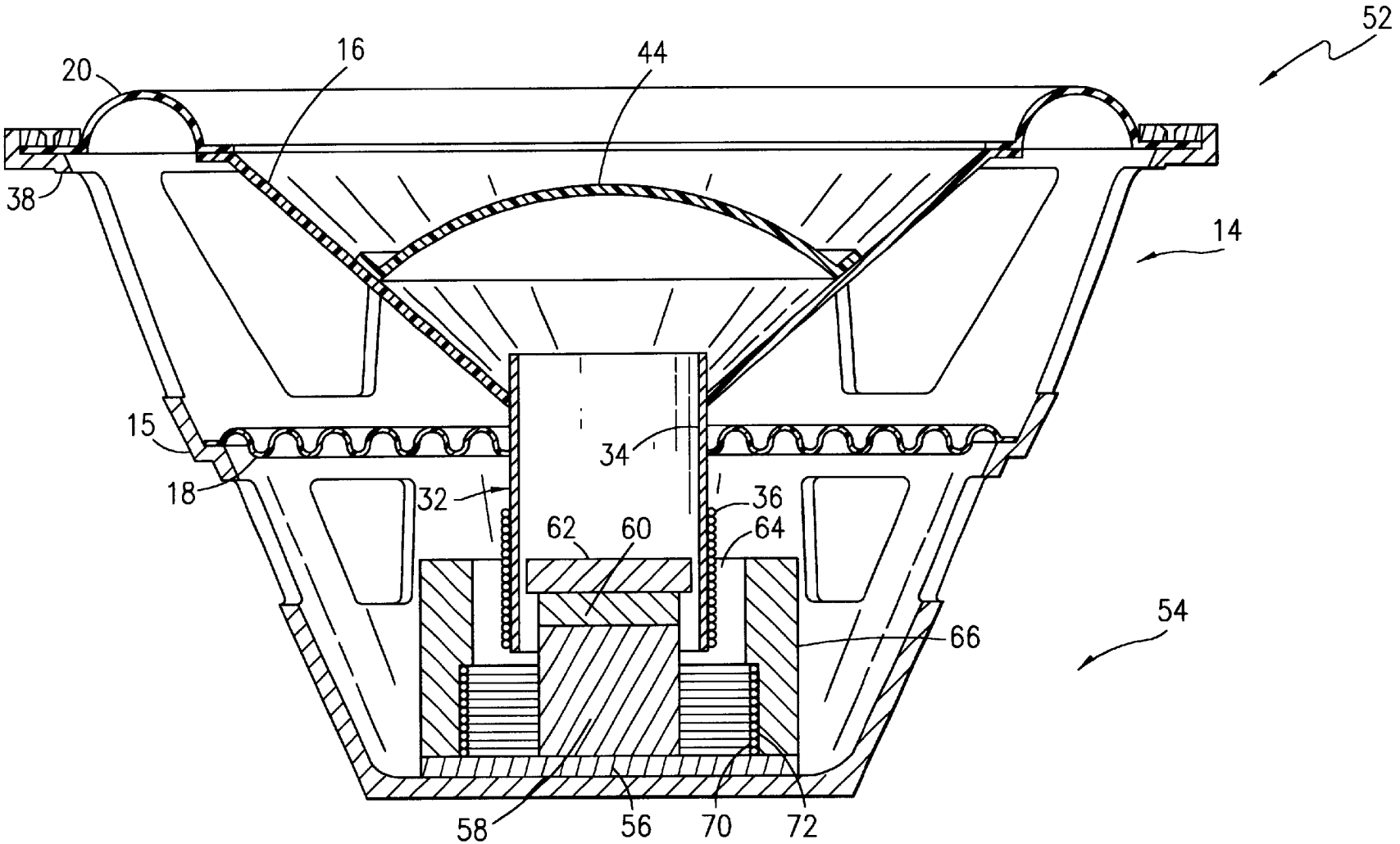
FIG. 4 is a view similar to FIG. 3 except with a variation of the field winding.

With reference to FIGS. 3 and 4, a loudspeaker 52 is disclosed employing a "pot" type motor structure 54. The upper portion of loudspeaker 52 is essentially identical to that of loudspeaker 10 depicted in FIGS. 1 and 2, and the same reference numbers are therefore used in FIGS. 3 and 4 to depict the same structure previously discussed in connection with loudspeaker 10.

In FIGS. 3 and 4, the frame 14 extends to the base of loudspeaker 52 and mounts a back plate 56. A pole piece 58 is mounted at the center of back plate 56 having an upper end which supports a permanent magnet 60. The permanent magnet 60, in turn, mounts a top plate 62 which forms a magnetic gap 64 with a pot wall 66 concentrically disposed about the pole piece 58, the magnet 60 and the top plate 62. The voice coil 32 is axially movable within the magnetic gap 64 in the same fashion as it moves within the magnetic gap 29 of loudspeaker 10. With reference to FIG. 3, a field winding 68 is coiled around the pole piece 58 and extends from the back plate 56 upwardly in a direction toward the top plate 62. In the alternative embodiment of the loudspeaker 52 shown in FIG. 4, a field winding 70 is mounted within a recess 72 in the pot wall 66, extending upwardly from the back plate 56 towards the top plate 62

System Operation

The permanent magnets 26 and 60 of the loudspeakers 10 and 52, respectively, disclosed in FIGS. 1–4 produce an essentially "static" or constant magnitude magnetic flux within the magnetic gaps 29 and 64. In the course of operation of speakers 10 and 52, electrical energy is supplied to the wire winding 36 of voice coil 32 causing the wire winding 36 to produce an AC magnetic flux which alternately reinforces or opposes the static DC magnetic flux produces by magnets 26 and 60. As noted above, the force exerted by the AC flux of the voice coil 32 modulates the static DC flux of the magnets 26 and 60, thus creating a source of distortion in loudspeakers 10 and 52. Further, the production of an essentially constant magnetic flux by the magnet does not permit alteration of the frequency response or damping characteristics of the loudspeakers 10, 52.

These inherent limitations in the speakers 10 and 52 have been addressed by the addition of field windings 48 and 50 in speaker 10, and the field windings 68 and 70 in speaker 52. For purposes of the present discussion, the operation and effect of field winding 48 is described herein, it being understood that field windings 50, 68 and 70 function in essentially the same manner.

Figure 5:
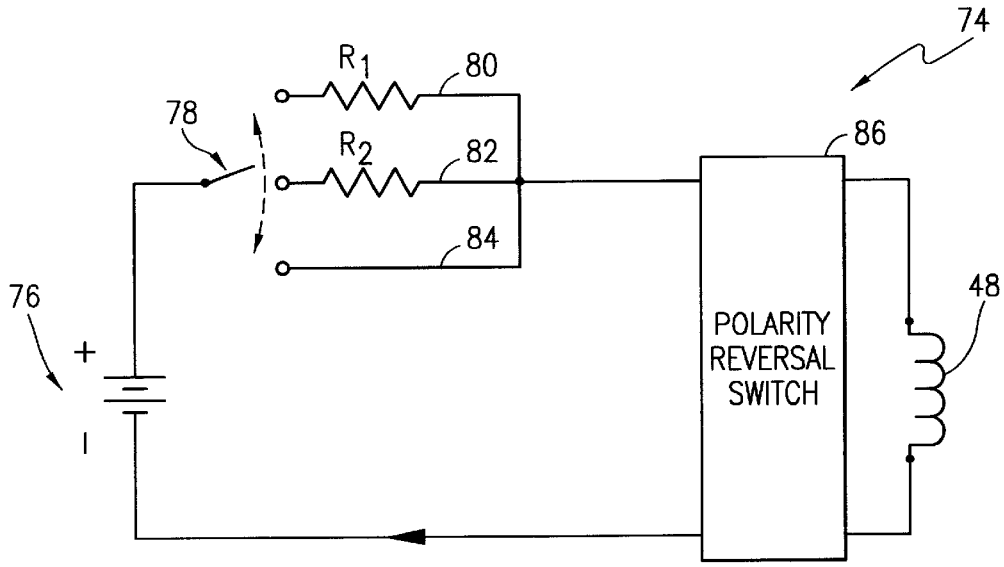
FIG. 5 is a schematic view of one form of the magnetic flux control circuit herein.
Figure 6:
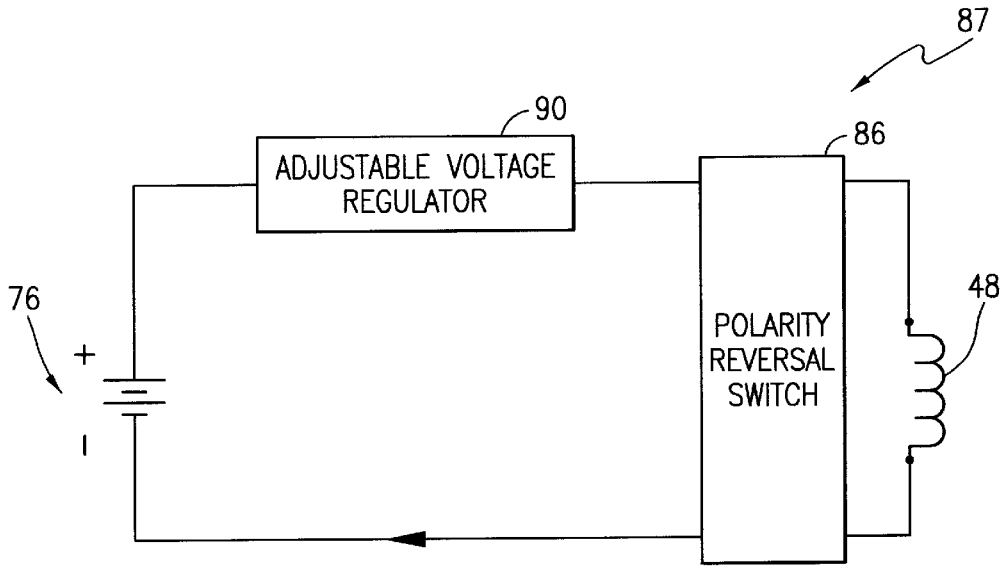
FIG. 6 is a schematic view of an alternative embodiment of the magnetic flux control circuit of this invention.
Figure 7:
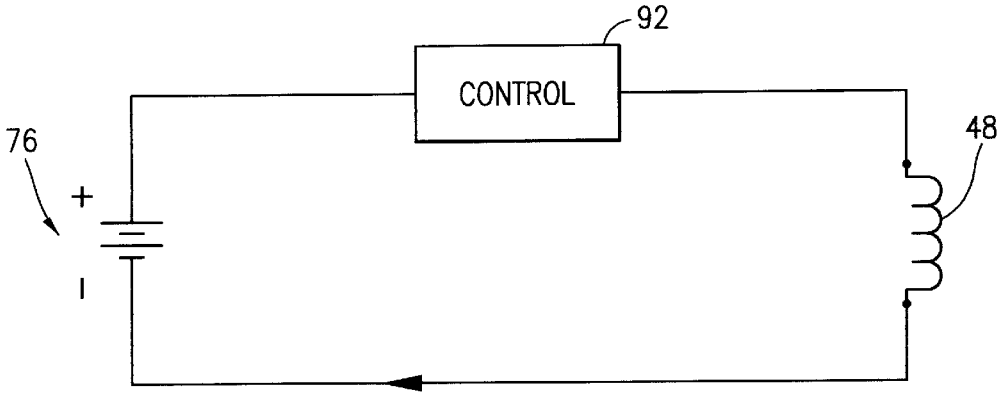
FIG. 7 is a still further embodiment of the magnetic flux control circuit.

With reference to FIG. 5, one embodiment of a magnetic flux control system 74 is schematically depicted. The system 74 consists of a voltage source 76 serially connected to a resistance controller comprising a triple throw switch 78, a first line 80 containing a resistor R1, a second line 82 arranged in parallel to the first line 80 and containing a resistor R2, and, a third parallel line 84 having no resistor. The lines 80, 82 and 84 are serially connected to a polarity reversal switch 86, which, in turn, is connected to opposite ends of the field winding 48. The polarity reversal switch 86 is connected to the voltage source 76. The switch 78 is connectable to either the first line 80, the second line 82 or the third line 84, depending on the level of current to be supplied to the field winding 48, as described more fully below. For purposes of the present discussion, the voltage source 76 is assumed to be the battery of a vehicle (not shown), within which the speakers 10 or 52 are included as part of an audio system for an automobile, truck or the like. The voltage source 76 or battery has a positive terminal and a negative terminal as schematically depicted in FIGS. 5–7. It should be understood that this invention is not limited to vehicle applications, but could be utilized in essentially any audio system.

In the control system 74 of FIG. 5, voltage provided by the voltage source 76 is passed either unaltered to the field winding 48 via line 84, or additional inline resistance can be introduced through the resistor R1 in line 80 or the resistor R2 in line 82. In order to avoid excessive power dissipation, either in the system 74 or remainder of the speaker 10 or 52, the field winding 48 can be provided with relatively high resistance, e.g. a DC resistance of about 7.618 ohms, created by 394 turns of the wire winding, in one presently preferred example. If the switch 78 is positioned to connect to line 84, thereby connecting the voltage source 76 directly to the field winding 48, the maximum power dissipated is approximately 25 watts which is comfortably below levels which would create problems with excess heat buildup either in the field winding 48 or the rest of the speaker 10 or 52. The addition of inline resistance via either of the resistors R1 or R2 effectively lowers the current supplied to the field winding 48, since the voltage source 76 produces a fixed voltage level, and thus reduces the level of magnetic flux produced by the field winding 48. Adding inline resistance also causes the power dissipation to be redistributed between the resistance of the resistors R1 or R2 and the DC resistance of the field winding 48.

As noted above, the purpose of the field winding 48 is to alter he force applied by the motor structure 12 or 54 on the voice coil 32 which is an indication of the "motor strength." The motor strength of he speakers 10 and 52 is given by the following relationship:

$$\text{Motor Strength} = \frac{(BL)^2}{R_e}$$

Where: $B$ = average peak magnitude of static magnetic flux in magnet gap $L$ = total length of voice coil wire acted Upon by $B$ $R_e$ = DC resistance of voice coil It is apparent that the motor strength as given above is directly related to the magnitude of the magnetic flux in the magnetic gap of the speaker 10 or 52. The field winding 48 is effective to create lines of magnetic flux which either reinforce or oppose the static magnetic flux produced by the permanent magnet 26 of the speaker 10, thus altering the variable "B" in the above equation. Depending on the orientation of the poles (north and south) of the magnet 26, and the position of the polarity reversal switch 86, electrical current is supplied to the field winding 48 which induces the formation of lines of magnetic flux which move either in a first direction or in a second, opposite direction. In one direction of movement, the lines of magnetic flux produced by the field winding 48 move in the same direction and reinforce the static lines of magnetic flux in the gap 29 produced by the permanent magnet 26. When the polarity reversal switch 86 is moved to its other position, the polarity of the current supplied to the field winding 48 is reversed thus creating lines of magnetic flux which move in a direction opposite to those produced by the permanent magnet 26. If the magnetic flux from the field winding 48 reinforces the magnetic field of the magnet 26, the motor strength increases (the variable B is increased) causing increased damping within the speaker 10. On the other hand, the variable B is decreased when the magnetic flux from the field winding 48 opposes the magnetic field of the magnet 26, causing a decrease in motor strength and less damping in the speaker.

In the particular embodiment of the control system 74 depicted in FIG. 5, an essentially fixed resistance is provided in the lines 80, 82 or 84, and therefore the resulting magnetic flux produced by the field winding 48 is also of a fixed level and cannot be varied except by employing a field winding 48 with a different resistance. Although capable of providing at least some variation in motor strength, the control system 74 of FIG. 5 is somewhat limited and is intended primarily for use in lower cost, simpler applications. Additional capability is provided in the magnetic flux control system 87 illustrated in FIG. 6. In this embodiment, the voltage source 76 is connected to an adjustable voltage regulator 90, which is an active (powered) component of the system. The voltage regulator 90, in turn, is connected to the polarity reversal switch 86 which connects to the field winding 48 as in FIG. 5. With the use of voltage regulator 90, the voltage, and hence current level, supplied to the field winding 48 can be changed to any value within the operating range of the voltage regulator 90, which, in turn, allows for adjustment of the magnitude of the magnetic flux produced by the field winding 48.

The use of a voltage regulator 90 in the control system 87 of FIG. 6 eliminates the heavy power dissipation of an inline resistor, as employed in the system 74 of FIG. 5. Additionally, the field winding 48 can be made with lower impedance, e.g. 0.898 ohms from 148 turns of wire in one presently preferred embodiment. Further, with the voltage regulator 90 positioned physically close to the field winding 48, the overall impedance of the control system 87 is comparatively low. This has a similar functional advantage as "shorting rings" employed in prior art systems. It is known to place a low impedance conductive ring, or shorting ring, circumferentially around the base of the pole piece in a speaker so that the flux produced by the magnet flows through the center of the ring. The passage of an AC magnetic flux through the center of the ring creates an electrical current, which, in turn, produces a corresponding AC magnetic "counter" flux, or lines of magnetic flux which alternate between a positive and negative polarity counter to the AC flux produced by the voice coil. This counter flux from the shorting ring opposes the AC magnetic flux produced in the voice coil, thereby tending to stop or reduce its modulation of the magnetic flux created by the permanent magnet. In order for the shorting ring to operate properly, it must have a very low electrical resistance so that the flux flowing through its center produces a large enough current to create an adequate counter flux. The low impedance control circuit 87, with the field coil 48 in the position shown in FIGS. 1 and 3, exhibits a similar function to the shorting ring and therefore has the added capability of reducing magnetic flux modulation created by the voice in coil 32, and, hence, distortion of the speaker 10 or 52.

While the discussion above has focused on the field winding 48 employed in the speaker 10 depicted in FIG. 1, it should be understood that the field windings 50, 68 and 70 of FIGS. 2, 3 and 4, respectively, function in essentially the same manner as the field winding 48. In each instance, for an excitation of the field winding 48, 50, 68 or 70 of approximately 25 watts, a variation in the motor strength 12 or 52 is obtained which is in the range of about plus or minus 15% to 20%. As noted above, the field winding 48 of FIG. 1 is positioned within a recess 46 formed in the pole piece 30, whereas, the field winding 50 of FIG. 2 is free-standing in the bore 28 between the pole piece 30 and permanent magnet 26. In the embodiment of the speaker 52 shown in FIG. 3, the field winding 68 is coiled directly to the pole piece 30, while the field winding 70 of FIG. 4 is mounted to the pot wall 66. Although equally effective in producing a magnetic flux to alter that produced by the magnet 60, it is contemplated that the location of the field winding 70 in the pot wall 66 will result in better heat dissipation than the field winding 68 located at the pole piece 30. Otherwise, the two embodiments shown in FIGS. 3 and 4 are functionally the same.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

For example the magnetic flux control system 74 illustrated in FIG. 5 employs lines 80, 82 and 84 with resistors R1, R2 or no resistance, respectively. It is contemplated that additional parallel lines could be employed, each with a different resistor, as desired. Further, the level of resistance for each resistor could be changed from one embodiment of the invention to another depending upon the requirements of a particular speaker.

Additionally, FIG. 7 is included to depict a further embodiment of the invention wherein the polarity reversal switch 86 employed in FIGS. 5 and 6 is eliminated. The "control 92" shown in FIG. 7 is meant to refer either to the parallel resistors in lines 80, 82 and 84 of FIG. 5, or to the adjustable voltage regulator 90 of FIG. 6. It is contemplated that polarity reversal could be achieved in the embodiment of FIG. 7 by reversing the position of the lines connected to the field winding 48, which of course could be done in the embodiment of FIGS. 5 and 6 as well.

Therefore, it is intended that the invention not be limited to the particular embodiment disclosed as the best mode contemplated for carrying out this invention, but that the invention will include all embodiments falling within the scope of the appended claims.

We claim:

1. A loudspeaker, comprising:

a motor structure including a back plate, a top plate, a magnetic gap and a permanent magnet interposed between said back plate and top plate which creates magnetic flux within said magnetic gap;

a frame having a first end connected to an upper suspension and a second end connected to said motor structure;

a voice coil movable within said magnetic gap, said voice coil being connected to a diaphragm which extends between said voice coil and said upper suspension, said voice coil having an outer surface wrapped with a wire winding which is adapted to connect to a source of electrical energy, said voice coil producing a magnetic flux when energized with electrical energy which alternately opposes and reinforces said magnetic flux created by said permanent magnet within said magnetic gap;

a magnetic flux control system adapted to connect to said source of electrical energy and including a field winding and a controller, said controller being manually adjustable to a desired setting to vary the level of electrical current supplied to said field winding so as to vary the magnetic flux produced by said field winding, said field winding being located within said motor structure in position such that said magnetic flux produced by said field winding is effective to either reinforce or to oppose the magnetic flux created by said permanent magnet within said magnetic gap.

2. The loudspeaker of claim 1 in which said motor structure further includes a pole piece, said permanent magnet and said top plate being concentrically disposed about said pole piece so that said magnetic gap is formed between said pole piece and said top plate, said field winding being coiled about said pole piece at a location spaced from said magnetic gap.

3. The loudspeaker of claim 2 in which said pole piece is formed with a recess, said field winding being coiled about said pole piece within said recess thereof.

4. The loudspeaker of claim 2 in which said field coil is affixed at one end to said back plate and is located in position between said pole piece and said permanent magnet.

5. The loudspeaker of claim 1 in which said motor structure further includes a pole piece connected between said back plate and said permanent magnet, and a pot wall concentrically disposed about said top plate forming said magnetic gap therebetween, said field winding being coiled about said pole piece at a location spaced from said magnetic gap.

6. The loudspeaker of claim 5 in which said field winding is mounted to said pot wall at a location spaced from said magnetic gap.

7. The loudspeaker of claim 1 in which said controller includes an adjustable voltage regulator connected between said voltage source and said field winding.

8. The loudspeaker of claim 1 in which said controller includes a switch, at least one first line having a resistance device and a second line with no resistor device which is arranged in parallel to said first line, said first and second lines being connected in series between said voltage source and said field winding, said switch being movable between a first position in which a completed circuit is formed between said voltage source, said first line and said field winding, and, a second position in which a completed circuit is formed between said voltage source, said second line and said field winding.

9. The loudspeaker of claim 1 in which said controller includes a switch, a first line having a resistor R, and a second line having a resistor R2 arranged as parallel to said first line, said first and second lines being connected in series between said voltage source and said field winding, said switch being movable between a first position in which a completed circuit is formed between said voltage source, said first line and said field winding, and, a second position in which a completed circuit is formed between said voltage source, said second line and said field winding.

10. The loudspeaker of claim 1 in which said magnetic flux control system further includes a polarity reversal switch which is effective to change the polarity of the electrical current supplied to the field winding.

11. A loudspeaker, comprising:

a motor structure including a back plate, a top plate, a magnetic gap and a permanent magnet interposed between said back plate and top plate which creates magnetic flux within said magnetic gap;

a frame having a first end connected to an upper suspension and a second end connected to said motor structure;

a voice coil movable within said magnetic gap, said voice coil being connected to a diaphragm which extends between said voice coil and said upper suspension, said voice coil having an outer surface wrapped with a wire winding which is adapted to connect to a source of electrical energy, said voice coil producing a magnetic flux when energized with electrical energy which alternately opposes and reinforces said magnetic flux created by said permanent magnet within said magnetic gap;

a magnetic flux control system adapted to connect to said source of electrical energy and including a field winding and a controller, said controller being manually adjustable to a desired setting to vary the level and polarity of electrical current supplied to said field winding so as to vary the magnetic flux produced by said field winding, said field winding being located within said motor structure in position such that said magnetic flux produced by said filed winding is effective to either reinforce or to oppose the magnetic flux created by said permanent magnet within said magnetic gap.

12. A loudspeaker, comprising:

a motor structure including a back plate, a top plate, a permanent magnet connected between said back plate and said top plate, and, a pole piece concentrically disposed within said top plate forming a magnetic gap therebetween within which magnetic flux is created by said permanent magnet;

a frame having a first end connected to an upper suspension and a second end connected to said motor structure;

a voice coil movable within said magnetic gap, said voice coil being connected to a diaphragm which extends between said voice coil and said upper suspension, said voice coil having an outer surface wrapped with a wire winding which is adapted to connect to a source of electrical energy, said voice coil producing a magnetic flux when energized with electrical energy which alternately opposes and reinforces said magnetic flux created by said permanent magnet within said magnetic gap;

a magnetic flux control system adapted to connect to said source of electrical energy and including a field winding and a controller, said controller being manually adjustable to a desired setting to vary the level and polarity of electrical current supplied to said field winding so as to alter the magnetic flux produced by said field winding, said field winding being located within said motor structure in position such that said magnetic flux produced by said field winding is effective to either reinforce or to oppose the magnetic flux created by said permanent magnet within said magnetic gap.

13. The loudspeaker of claim 12 in which said pole piece is formed with a recess spaced from said magnetic gap, said field winding being coiled about said pole piece within said recess thereof.

14. The loudspeaker of claim 12 in which said field coil is affixed at one end to said back plate and is located in position between said pole piece and said permanent magnet.

15. The loudspeaker of claim 12 in which said controller is an adjustable voltage regulator connected between said voltage source and said field winding.

16. The loudspeaker of claim 12 in which said controller includes a switch, at least one first line having a resistance device and a second line with no resistance device which is arranged in parallel to said first line, said first and second lines being connected in series between said voltage source and said field winding, said switch being movable between a first position in which a completed circuit is formed between said voltage source, said first line and said field winding, and, a second position in which a completed circuit is formed between said voltage source, said second line and said field winding.

17. The loudspeaker of claim 12 in which said controller includes a switch, a first line having a resistor R1 and a second line having a resistor R2 arranged in parallel to said first line, said first and second lines being connected in series between said voltage source and said field winding, said switch being movable between a first position in which a completed circuit is formed between said voltage source, said first line and said field winding, and, a second position in which a completed circuit is formed between said voltage source, said second line and said field winding.

18. The loudspeaker of claim 12 in which said magnetic flux control system further includes a polarity reversal switch which is effective to change the polarity of the electrical current supplied to the field winding.

19. A loudspeaker, comprising:

a motor structure including a back plate, a top plate, a pole piece connected to said back plate, a permanent magnet connected between said pole piece and said top plate and a pot wall concentrically disposed about said top plate forming a magnetic gap therebetween within which magnetic flux is created by said permanent magnet;

a frame having a first end connected to an upper suspension and a second end connected to said motor structure;

a voice coil movable within said magnetic gap, said voice coil being connected to a diaphragm which extends between said voice coil and said upper suspension, said voice coil having an outer surface wrapped with a wire winding which is adapted to connect to a source of electrical energy, said voice coil producing a magnetic flux when energized with electrical energy which alternately opposes and reinforces said magnetic flux created by said permanent magnet within said magnetic gap;

a magnetic flux control system adapted to connect to said source of electrical energy and including a field winding and a controller, said controller being manually adjustable to a desired setting to vary the level of electrical current supplied to said field winding so as to alter the magnetic flux produced by said field winding, said field winding being located within said motor structure in position such that said magnetic flux produced by said field winding is effective to either reinforce or to oppose the magnetic flux created by said permanent magnet within said magnetic gap.

20. The loudspeaker of claim 19 in which said field winding is coiled about said pole piece at a location spaced from said magnetic gap.

21. The loudspeaker of claim 19 in which said field winding is mounted to said pot wall at a location spaced from said magnetic gap.

22. The loudspeaker of claim 19 in which said controller includes an adjustable voltage regulator connected between said voltage source and said field winding.

23. The loudspeaker of claim 19 in which said controller includes a switch, at least one first line having a resistance device and a second line with no resistance device which is arranged in parallel to said first line, said first and second lines being connected in series between said voltage source and said field winding, said switch being movable between a first position in which a completed circuit is formed between said voltage source, said first line and said field winding, and, a second position in which a completed circuit is formed between said voltage source, said second line and said field winding.

24. The loudspeaker of claim 19 in which said controller includes a switch, a first line having a resistor R1 and a second line having a resistor R2 arranged in parallel to said first line, said first and second lines being connected in said first and second lines being connected in series between said voltage source and said field winding, said switch being movable between a first position in which a completed circuit is formed between said voltage source, said first line and said field winding, and, a second position in which a completed circuit is formed between said voltage source, said second line and said field winding.

25. The loudspeaker of claim 19 in which said magnetic flux control system further includes a polarity reversal switch which is effective to change the polarity of the electrical current supplied to the field winding.

26. A loudspeaker, comprising:

a motor structure including a back plate, a top plate, a magnetic gap and a permanent magnet interposed between said back plate and top plate which creates magnetic flux within said magnetic gap;

a frame having a first end connected to an upper suspension and a second end connected to said motor structure;

a voice coil movable with said magnetic gap, said voice coil being connected to a diaphragm which extends between said voice coil and said upper suspension, said voice coil having an outer surface wrapped with a wire winding which is adapted to connect to a source of electrical energy, said voice coil producing a magnetic flux when energized with electrical energy which alternately opposes and reinforces said magnetic flux created by said permanent magnet within said magnetic gap;

a field winding having opposed ends adapted to connect to said source of electrical energy including a positive terminal and a negative terminal, said field winding being located within said motor structure in position such that the magnetic flux produced by said field winding is effective to either reinforce or to oppose the magnetic flux created by said permanent magnet within said magnetic gap dependent on the connection of said opposed ends of said field winding to the terminals of said source of electrical energy; and a polarity reversal switch which is effective to change the polarity of the electrical current supplied to said field winding by said source of electrical energy.

27. The method of adjusting the motor strength of a loudspeaker comprising:

(a) providing a motor structure having a magnetic gap within which magnetic flux is created by a permanent magnet, said motor structure including a voice coil having an outer surface wrapped with a wire winding connected to a source of electrical energy;

(b) applying electrical energy to said voice coil from the source to produce a magnetic flux which alternately opposes and reinforces the magnetic flux created by said permanent magnet;

(c) providing a field winding within said motor structure, and connecting the field winding to said source of electrical energy;

(d) manually controlling the level of the electrical current supplied to the field winding so that the magnetic flux produced by the field winding is effective either to reinforce or to oppose the magnetic flux of the permanent magnet within the magnetic gap.

28. The method of claim 27 in which step (d) comprises adjusting an adjustable voltage regulator connected between a source of voltage and the field winding.

29. The method of claim 27 in which step (d) comprises switching between at least one first line having a resistance device and a second line, each of the first and second lines being connected between a source of voltage and the field winding.

30. The method of claim 27 further including: (e) controlling the polarity of the electrical current supplied to the field winding.

31. The method of claim 30 in which step (e) comprises operating a polarity reversal switch connected to opposite ends of the field winding.

* * * * *